United States Patent [19]

König

[11] 4,079,706

[45] Mar. 21, 1978

[54] TWO-STROKE INTERNAL COMBUSTION ENGINE

[75] Inventor: Dieter Ernst Max König, Berlin, Germany

[73] Assignee: AB Volvo Penta, Goteborg, Sweden

[21] Appl. No.: 700,349

[22] Filed: Jun. 28, 1976

[30] Foreign Application Priority Data

Jun. 27, 1975 Sweden ..... 7507406

[51] Int. Cl.[2] ..... F02B 33/04; F02B 75/20

[52] U.S. Cl. ..... 123/73 D; 123/59 B; 123/73 V; 123/190 DA

[58] Field of Search ..... 123/59 B, 73 V, 73 D, 123/73 DA, 80 D, 190 D, 190 DA; 137/624.13; 417/518, 519, 539

[56] References Cited

U.S. PATENT DOCUMENTS

| | | | |
|---|---|---|---|
| 1,436,434 | 11/1922 | Conners | 123/190 DA |
| 1,820,093 | 8/1931 | Seifert | 123/73 D |
| 2,630,791 | 3/1953 | Kiekhaefer | 123/73 V |
| 2,648,318 | 8/1953 | Bensinger | 123/80 D |
| 3,628,518 | 12/1971 | Blair | 123/73 V |

FOREIGN PATENT DOCUMENTS 1,170,708 5/1964 Germany.

*Primary Examiner*—Charles J. Myhre
*Assistant Examiner*—David D. Reynolds
*Attorney, Agent, or Firm*—Young & Thompson

[57] ABSTRACT

An internal combustion engine has at least three cylinders and induction conduits opening into the lower portion of the cylinders or into the crankcase. The induction conduits are intended at least for combustion air, comprising at least one rotary disc valve rotatably driven by the crankshaft of the engine. The valve has the form of a disc whose rotation axis crosses or intersects the crankshaft of the engine and is arranged in a valve housing through which the induction conduits extend, said valve being designed to alternately open and close the passages of the induction conduits through the valve housing. Said valve housing has at least three induction conduit inlets and is driven at an rpm which is lower than the crankshaft rpm and has a number of sets of recesses corresponding to the rpm reduction for control of the induction.

6 Claims, 11 Drawing Figures

TWO-STROKE INTERNAL COMBUSTION ENGINE

The present invention relates to a multi-cylinder two-stroke internal combustion engine having induction conduits opening into the lower portion of the cylinders or into the crankcase, said induction conduits being intended at least for combustion air, comprising at least one rotary disc valve rotatably driven by the crankshaft of the engine, said valve valve being in the form of a disc whose rotation axis crosses or intersects the crankshaft of the engine and being arranged in a valve housing through which the induction conduits extend, said being designed to alternately open and close the passages of the induction conduits through the valve housing.

It is previously known by for example German Patent Specification No. 1 170 708 to design a two-cylinder engine in the manner described above, whereby several advantages are obtained in comparison to conventional control of induction, for example by means of plate valves. More effective filling of the cylinders is achieved by means of the arrangement, i.a. allowing long opening time with quick opening and closing. Other advantages are obtained as well, as is revealed in said patent specification.

In the known engine the valve has the form of a sector of a circle which, via a gear, is driven by the rotation of the crankshaft. Two induction conduits extend through the valve housing, said conduits being opened and closed by the valve. Having one valve, the known construction is restricted to two-cylinder in-line engines and four-cylinder V- or opposed-cylinder engines as the sector-shaped disc is not capable of individually controlling induction through three induction conduits due to the fact that the length of the opening portion of said disc would cause "shorts" in adjacent conduits unless they were angularly spaced at a distance of 120°. However, this is not applicable in practice as the arrangement of the induction conduits becomes much too complicated and causes great flow losses.

The purpose of the present invention is to solve the above-mentioned problem and achieve an engine of the kind disclosed in the preamble having more than two cylinders, that is, a three- or six-cylinder engine having one single valve disc.

According to the invention this is achieved by means of the slide housing having at least three induction conduit inlets, by means of the disc valve being driven at an rpm which is lower than the rpm of the crankshaft and by means of the valve housing having a number of sets of recesses corresponding to rpm reduction for control of induction.

In a preferred embodiment the disc valve is driven by a reduction gear at half the crankshaft rpm and has two sets of recesses arranged at a 180° angular distance from each other.

When the crankshaft is rotated said sets alternately control induction to the cylinders. By means of the disc valve rotating at half the rpm, the apertures and recesses can be designed to be so short that "shorting" between adjacent conduits cannot take place, simultaneously as no reduction of the induction efficiency takes place.

The invention is described in more detail below with reference to the accompanying drawings illustrating embodiments in which FIG. 1 is a frontal view of a three-cylinder engine according to the invention;

Figure 7:
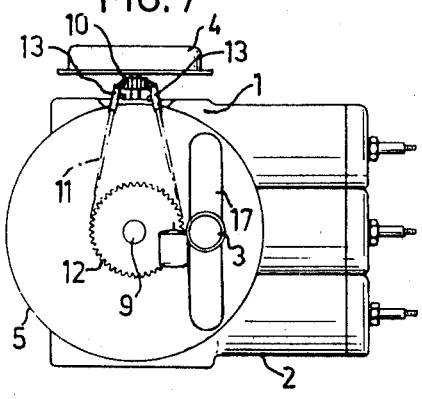
Figure 8:
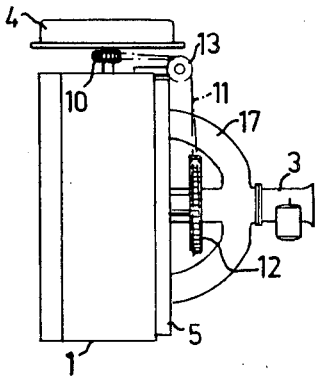
Figure 9:
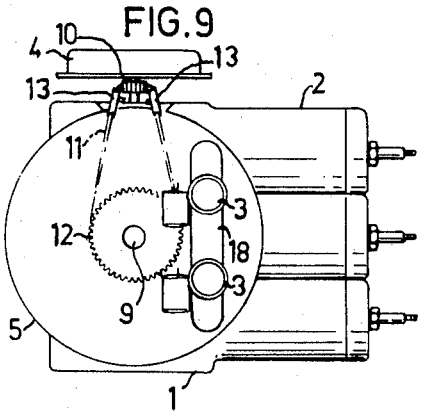
Figure 10:
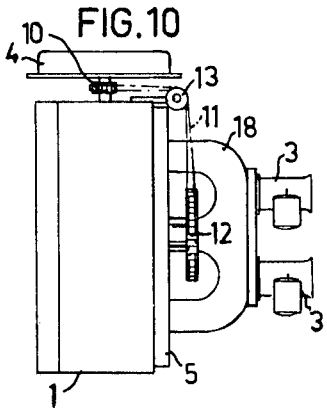
Figure 11:
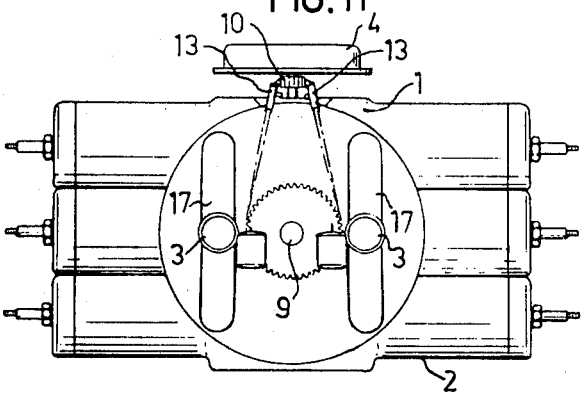

FIGS. 7 and 8 are a side view and a frontal view of a single carburetor engine illustrating driving of the slide, FIGS. 9 and 10 are views corresponding to FIGS. 7 and 8 of a double carburetor engine and FIG. 11 is a view as seen from above of a six-cylinder opposed-cylinder engine.

The engines shown in FIGS. 1–4 are illustrated in an extremely simplified manner as their general construction can be conventional and thus not call for any detailed description. Both of the engines have an engine block 1 having three cylinders 2 and three separate carburetors 3, one for each cylinder. A flywheel 4 is powered by the crankshaft.

The carburetors 3 are screwed onto a valve housing 5 which, as is illustrated, can be cast integrally with the engine block or comprise a separate housing screwed onto the block. The housing 5 has induction conduits 6, one for each cylinder, which, as in the embodiment shown in FIGS. 1 and 2, open into the bottom of the crankcase 7 and, as in FIGS. 3 and 4, open into the lower portion of the cylinders 2. The housing 5 can, according to need, be positioned at any point between the illustrated positions.

A valve 8 in the form of a thin circular metal disc is rotatably arranged inside the housing 5. The disc 8 is attached to an axle pin 9 which is rotatably journalled in the housing and supports a gear drive 12. This gear drive 12 is powered via a gear belt 11 by a gear drive 10 on the crankshaft, the reduction being 1:2 in the shown embodiment. As is shown in more detail in FIGS. 7–10, the gear belt passes over a pair of rollers 13.

Figure 1:
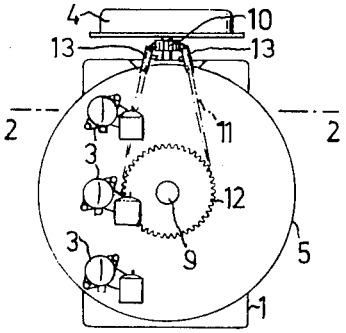
Figure 3:
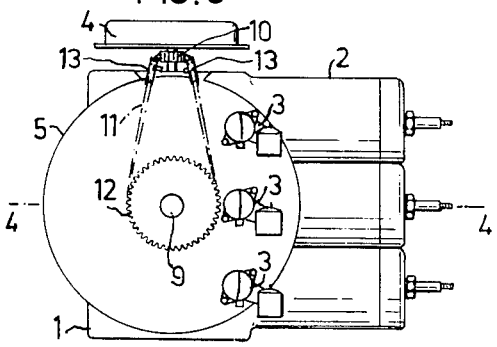
FIG. 3 is a side view of an engine in a somewhat modified embodiment.
Figure 2:
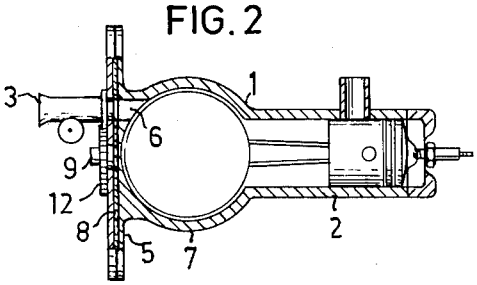
FIG. 2 is a section along the line 2—2 in FIG. 1.
Figure 4:
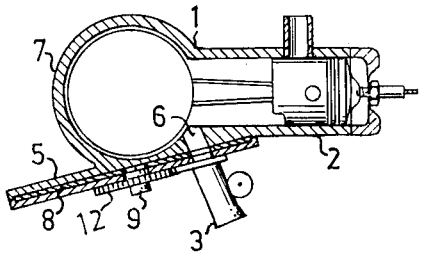
FIG. 4 is a section along the line 4—4 in FIG. 3.
Figure 5:
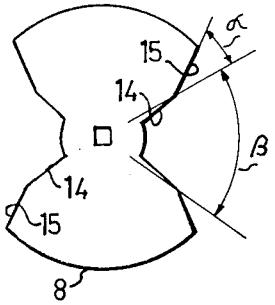
FIG. 5 is a planar view of the disc valve.

In FIG. 5 the disc 8 has two diametrically opposed sets of recesses comprising a radial inner recess 14 and a radial outer recess 15. During rotation the disc 8 will, due to the recesses 14,15, intermittently open the induction conduits 6. The outer recesses 15 control induction to the upper and lower cylinders, while the inner recesses 14 control induction to the intermediate cylinder which is situated closer to the rotation axis of the disc 8; this in view of the fact that the induction conduits are arranged in a row. When the crankshaft is rotated two rounds, induction is first controlled by one set of recesses and then by the other.

Figure 6:
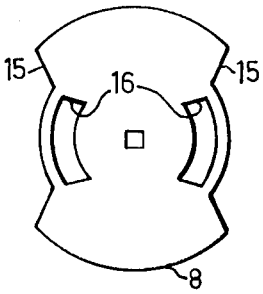
FIG. 6 is a view of the disc according to FIG. 5 in a somewhat modified form.

In FIG. 6 another embodiment of the disc 8 is shown which differs from the previous embodiment in that the inner recesses are replaced by apertures 16.

FIGS. 7 and 8 show an engine having an induction tube 17 with a carburetor 3, and FIGS. 9 and 10 show an engine having an induction tube 18 with two carburetors 3. As in the previously-described arrangements, both of these embodiments have three induction passages passing through the valve housing 5.

FIG. 11 shows a six-cylinder engine having two opposed rows of cylinders, each row having three cylinders 2. This engine differs from the engine shown in FIGS. 7 and 8 only in that it has a further row of cylinders and in that the valve housing 5 has three induction conduits for said further row of cylinders to which an induction tube 17 leads. It is also possible to have only three induction conduits in a six-cylinder engine, each induction conduit thereby feeding two opposed cylinders firing simultaneously. Such an engine would have a valve housing corresponding to that shown in FIGS. 2 or 4.

In the above the invention has been described with reference to embodiments having an rpm reduction of 1:2 and two sets of recesses. However other rpm reductions are feasible within the framework of the invention. For example an rpm reduction of 1:3 can also be applied, in which three sets are arranged. Embodiments in which each set can be considered to be a single recess are also to be comprised in the definition "sets of recesses". Thus the recesses 14,15 in FIG. 5 can also be considered to be a single irregular recess.

Naturally, the invention is not restricted to a three-or six-cylinder engine having a single disc valve, Rather, the invention comprises all multicylinder engines whose number of cylinders are a multiple of three and which have several disc valves, for example a nine-cylinder engine having three disc valves.

What I claim is:

1. Internal combustion engine having at least three cylinders and having induction conduits opening into the lower portion of the cylinders or into the crankcase, said induction conduits being intended at least for combustion air, comprising at least one rotary disc valve rotatably driven by the crankshaft of the engine, said valve being in the form of a disc whose rotation axis crosses or intersects the crankshaft of the engine and being arranged in a valve housing through which the induction conduits extend, said valve being designed to alternately open and close the passages of the induction conduits through the slide housing, characterized in that the valve housing has at least three induction conduit inlets and that the valve is driven at an rpm which is lower than the crankshaft rpm and has a number of sets of recesses corresponding to the rpm reduction for control of induction.

2. Engine according to claim 1, characterized in that it is a three-cylinder in-line engine and in that the valve housing has three induction conduit inlets arranged in a row.

3. Engine according to claim 1, characterized in that it is a six-cylinder engine having two rows of cylinders and in that the valve housing has two rows of induction conduit inlets, three such inlets in each row.

4. Engine according to claim 1, characterized in that the disc is driven by a reduction gear at half the crankshaft rpm and in that it has two sets of recesses arranged at a 180° angular distance from each other.

5. Engine according to claim 1, characterized in that the induction conduit inlet lying in the middle of each row lies at a smaller radial distance from the rotation centre of the valve than the inlets arranged at the sides, said valve having the recesses for the conduit siutated in the middle of the row situated at a smaller radial distance from the rotation centre than the recesses for the conduits situated at the sides.

6. Engine according to claim 1, characterized in that the valve is driven by the crankshaft via a gear belt transmission.

* * * * *